US005535780A

United States Patent [19]

Schlecht et al.

[11] Patent Number: 5,535,780

[45] Date of Patent: Jul. 16, 1996

[54] CONCRETE-DISTRIBUTION RIG

[75] Inventors: Karl Schlecht, Filderstadt; Dieter Alwes, Aichtal, both of Germany

[73] Assignee: Putzmeister-Werk Maschinenfabrik GmbH, Aichtal, Germany

[21] Appl. No.: 338,588

[22] PCT Filed: Sep. 16, 1993

[86] PCT No.: PCT/EP93/02503

§ 371 Date: Nov. 14, 1994

§ 102(e) Date: Nov. 14, 1994

[87] PCT Pub. No.: WO94/08111

PCT Pub. Date: Apr. 14, 1994

[30] Foreign Application Priority Data

Oct. 2, 1992 [DE] Germany ..... 42 33 171.4

[51] Int. Cl.[6] ..... B67D 5/64

[52] U.S. Cl. ..... 137/615; 141/387

[58] Field of Search ..... 137/615; 141/387

[56] References Cited

U.S. PATENT DOCUMENTS 3,625,760 12/1986 Mertens ..... 137/615

3,707,990 1/1973 Schaible et al. ..... 137/615

4,130,134 12/1978 Castle ..... 137/615

4,457,338 7/1984 Moller et al. ..... 137/615

4,828,033 5/1989 Frison ..... 137/615

4,924,898 5/1990 Evenson ..... 137/615

*Primary Examiner*—A. Michael Chambers

*Attorney, Agent, or Firm*—Flynn, Thiel, Boutell & Tanis

[57] ABSTRACT

The invention concerns a five-arm concrete-distribution rig (20) mounted on a vehicle. Arms (1, 2 and 3) can be folded together by pivoting in opposite directions about hinged joints (B and C), which are capable of pivoting through approximately 180°, to form a "Z". In order to make it possible to supply concrete through several hoses in parallel, to upper stories and over obstacles, the invention proposes that arms (3, 4 and 5) can be folded together by pivoting in the same direction about joints (D and E), which are capable of pivoting through approximately 270°, to bring them up against arms (2 and 3) in the vicinity of hinged joint (C).

4 Claims, 4 Drawing Sheets

CONCRETE-DISTRIBUTION RIG

FIELD OF THE INVENTION

The invention relates to a five-arm concrete-distribution rig arranged on a vehicle comprising a rig arm 1 hinged to a horizontal pivot joint A on a pivot-bearing block which is arranged on the front axle side of the vehicle and rotatable about a vertical axis. The concrete-distribution rig further comprises rig arms 2, 3, 4 and 5 lying in a travelling position under the rig arm 1 and foldable in pairs at the hinged joints B, C, D and E against the respective preceding rig arm in an alignment essentially parallel to one another. The distribution rig also comprises pipe sections of a feed pipe, wherein the feed pipe can be loaded with concrete and leads to an end hose hinged to the free end of the rig arm 5, and wherein the pipe sections extend along the individual rig arms and are connected with one another at pipe rotating joints, which are axially parallel with respect to the hinged joints. The rig arms 1, 2 and 3 can be folded at their hinged joints B and C in opposite rotational directions so as to be against one another like a Z. The hinged joints B and C have a swivelling range of motion of approximately 180°.

BACKGROUND OF THE INVENTION

A concrete-distribution rig of this type is known (DE-PS 34 46 290), wherein all rig arms 1, 2, 3, 4 and 5 can be folded against one another at their hinged joints B, C, D and E like a multi-Z-folding. This concrete-distribution rig reaches very far and can be advantageously utilized both in the low-rise building construction and also in the high-rise building construction. The multi-Z-folding further guarantees a quick operational readiness after only a short lifting and partial unfolding of the arm package. The rig also provides a high flexibility, in particular, during the pouring of concrete or the concreting of difficult to access areas whereby dead spaces are essentially avoided during upward feed near the vehicle and also during the pouring of concrete in low spaces. In order to also achieve a mass distribution favorable for the load and moment to be absorbed by the chassis when in the folded travelling position, the hinged joints C and E near the front axle have a swivelling range of 270° between the arms 2 and 3 or 4 and 5, whereas the remaining hinged joints B and D have an angle of traverse of 180°. The pouring of concrete parallel to or along the working plane is possible with the multi-Z-folding. However, to guide the end hose all the way to the cab requires a relatively high unfolding height.

Furthermore, in a concrete-distribution rig with four rig arms, it is actually known to fold the rig arms 1, 2 and 3 against one another at their hinged joints B and C in opposite rotational directions like a Z and to fold the rig arm 4 at the joint D in the same rotational direction with the rig arms 2 and 3 against one another. This type of folding has been specially designed for pouring concrete in low spaces because the end hose can be moved over the entire work area from the cab to the maximum extension with a small unfolding height along a predetermined horizontal operating line. However, this four-arm distribution rig cannot be used to provide parallel hose guiding when concrete is supposed to be poured beyond obstacles or from the ground into higher stories.

SUMMARY OF THE INVENTION

The basic purpose of the invention is therefore to develop a concrete-distribution rig of the above-mentioned type, which can be used both in ground-level low spaces to overcome obstacles and also in higher stories for pouring concrete while guiding a hose parallel with the lowest possible unfolding height.

To attain this purpose it is suggested according to the invention that the rig arms 3, 4 and 5 and the associated pipe sections be roll folded, i.e. be folded against one another at their hinged joints D and E each in the same rotational direction with the rig arms 4 and 5 folded between the rig arms 2 and 3 in the area of the hinged joint C.

With these measures, the rig arm 2 serves both a guiding function during the ground-level concreting and a projecting function to overcome obstacles at the ground level and over several stories while permitting the successive rig arms 3, 4 and 5 to be used independent of the arm 2 to guide the hose parallel from their extended position directly to the obstacle being overcome with only a small unfolding height required. Further uses are made possible by the hinged joint D and/or the hinged joint E which each have an angle of traverse of approximately 270°.

In order to reduce the projection of the rig laterally and to thus improve its entry characteristics during introduction into narrow openings, a further advantageous development of the invention is suggested wherein all pipe sections and the associated pipe rotating joints each are arranged on the same side of the rig arm. With this arrangement, expensive rotary transmissions of the pipe rotating joints through the hinged joints are not needed.

BRIEF DESCRIPTION OF THE DRAWINGS

The invention will be discussed hereinafter in greater detail in connection with the drawings, in which.

DETAILED DESCRIPTION

Figure 1:
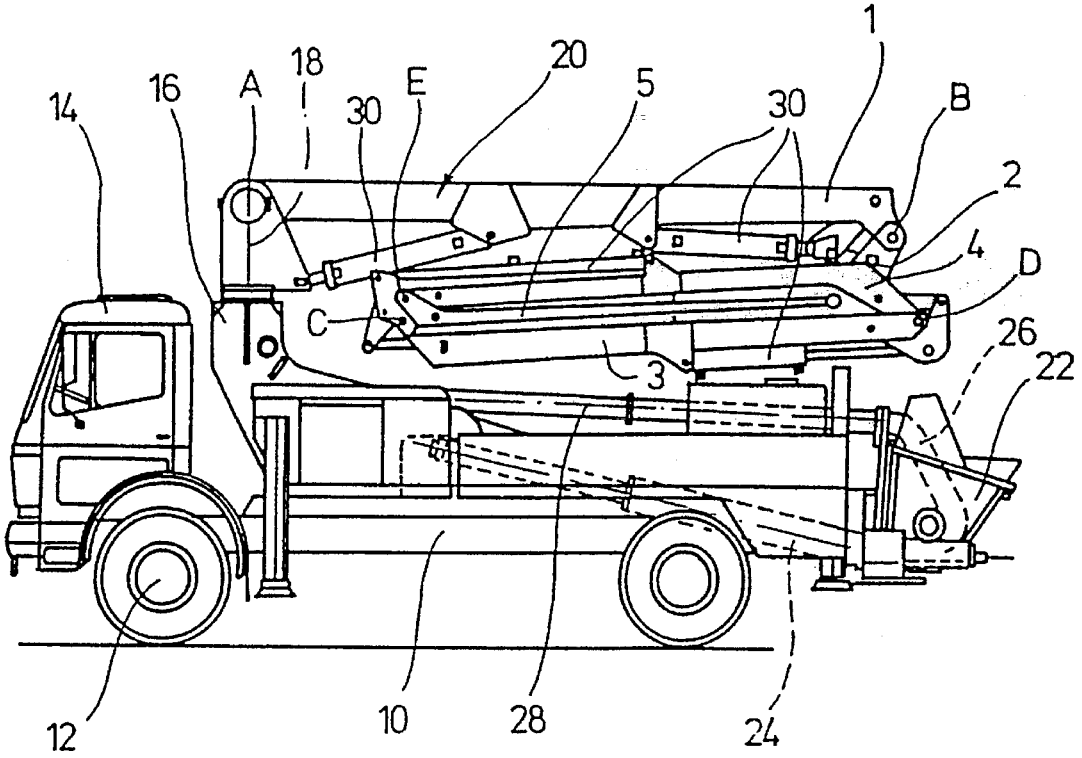
FIG. 1 is a side view of a mobile concrete pump illustrated with a five-arm concrete-distribution rig in the folded travelling position.

The mobile concrete pump illustrated in the drawings has a chassis 10, a pivot-bearing block 16 arranged near the front axle 12 and the cab 14 of the chassis 10, a distribution rig 20 rotatable at 360° about a vertical axis 18 on the pivot-bearing block 16, a hydraulically driven concrete pump 24, which can be loaded with concrete through a material-feeding container 22, and a feed pipe 28 connected to the concrete pump 24 through a pipe switch 26.

The distribution rig 20 has five rig arms 1, 2, 3, 4 and 5, wherein a rig arm 1 is connected at the pivot joint A to the pivot-bearing block 16 and rig arms 1, 2, 3, 4 and 5 are connected with one another at the respective hinged joints B, C, D and E. The folding in and out of the rig arms 1 to 5 about the joints A to E is accomplished hydraulically by means of double-acting hydraulic cylinders 30, which are hinged at their cylinder ends and rod ends to booms or folding bars of either the rig arms 1 to 5 or the pivot-bearing block 16. The pivot joint A has a swivelling range of motion of 90° to 100° the hinged joints B and C of approximately 180° and the hinged joints D and E of approximately 270°.

The rig arms 1 to 5 may be stored in the travelling position shown in FIG. 1 wherein the rig arms 1 to 5 are folded against one another so as to be aligned essentially parallel to one another, so that the rig arms 2, 3, 4 and 5 rest under the main arm 1. The rig arms 1, 2 and 3 are folded at their hinged joints B and C in opposite rotational directions so as to be folded against one another like a Z. The rig arms 3, 4 and 5, however, are folded against one another at their hinged joints D and E each in the same rotational direction such that the rig arms 4 and 5 are folded relative to the rig arms 2 and 3 in a manner similar to rolling, i.e. roll folding.

Figure 2A:
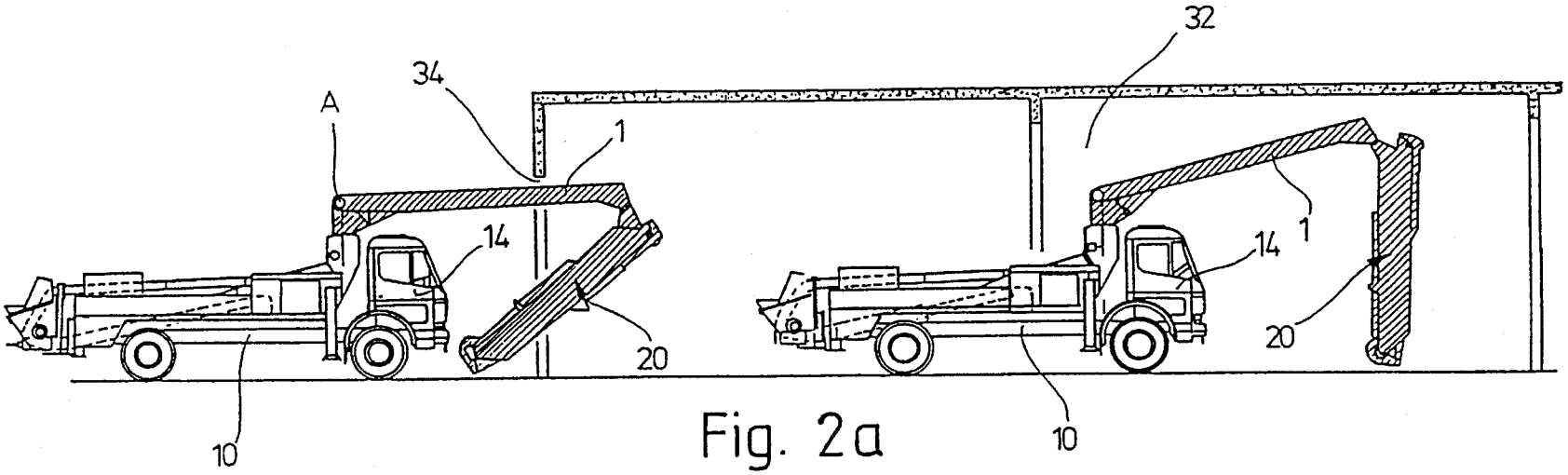
FIGS. 2*a* and 2*b* illustrate the mobile concrete pump according to FIG. 1 during travel into a hall of a factory and during ground-level concreting in this hall.
Figure 2B:
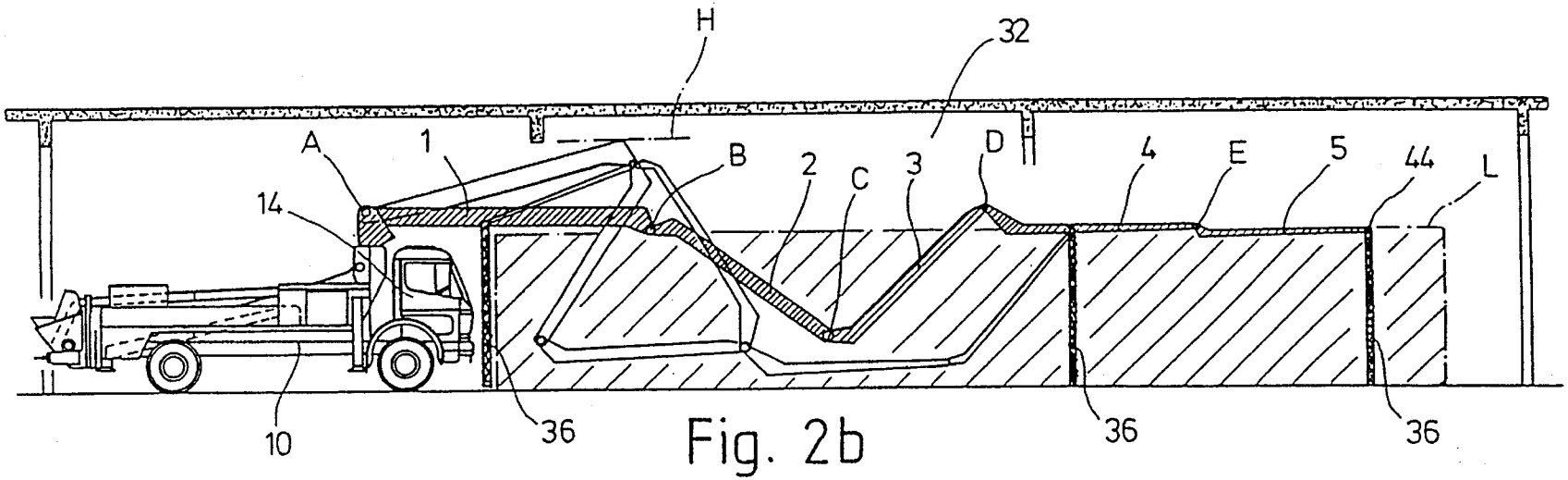

FIGS. 2*a* and 2*b* show the operation of the mobile concrete pump in performing a ground-level concreting of the floor located within a low-ceiling space, in particular within a hall 32 of a factory. The rig arms 2 to 5 are for this purpose first pivoted in front of the cab 14 in a downwardly folded position by lifting the main arm 1 slightly and rotating the pivot-bearing block 16. The rig arms 2 to 5 are then lowered far enough into an inclined position such that travel through the low entry gate 34 of the hall 32 of the factory is possible (left side of FIG. 2*a*). The rig arms 2 to 5 can be erected within the hall 32 of the factory and can be loaded by filling the feed pipe 28 with concrete (right side of FIG. 2*a*).

After the concrete-distribution rig 20 has been unfolded, as seen in FIG. 2*b*, the concreting of the floor starts at the point farthest away from the vehicle, namely through the flexible end hose 36, which hangs down at the free end of the rig arm 5 and which is directed toward the areas to be concreted by the operator. It is possible by suitably moving the rig arms 1 to 5 about their respective joints A to E to move the end hose 36 along an operating line L parallel with the floor until the end hose 36 is directly in front of the cab 14. Due to the special arrangement and the swivelling ranges of motion of the hinged joints B to E, the height H required to unfold the distribution rig 20 is only a little higher than the operating line L, through which the free end of the end arm 5 is manipulated. Only a few simple sequences of movement are then needed when the end hose 36 is in the end position near the cab shown in FIG. 2*b*, in order to move the rig arms 2 to 5 into their folded position shown on the right side in FIG. 2*a*.

Figure 3:
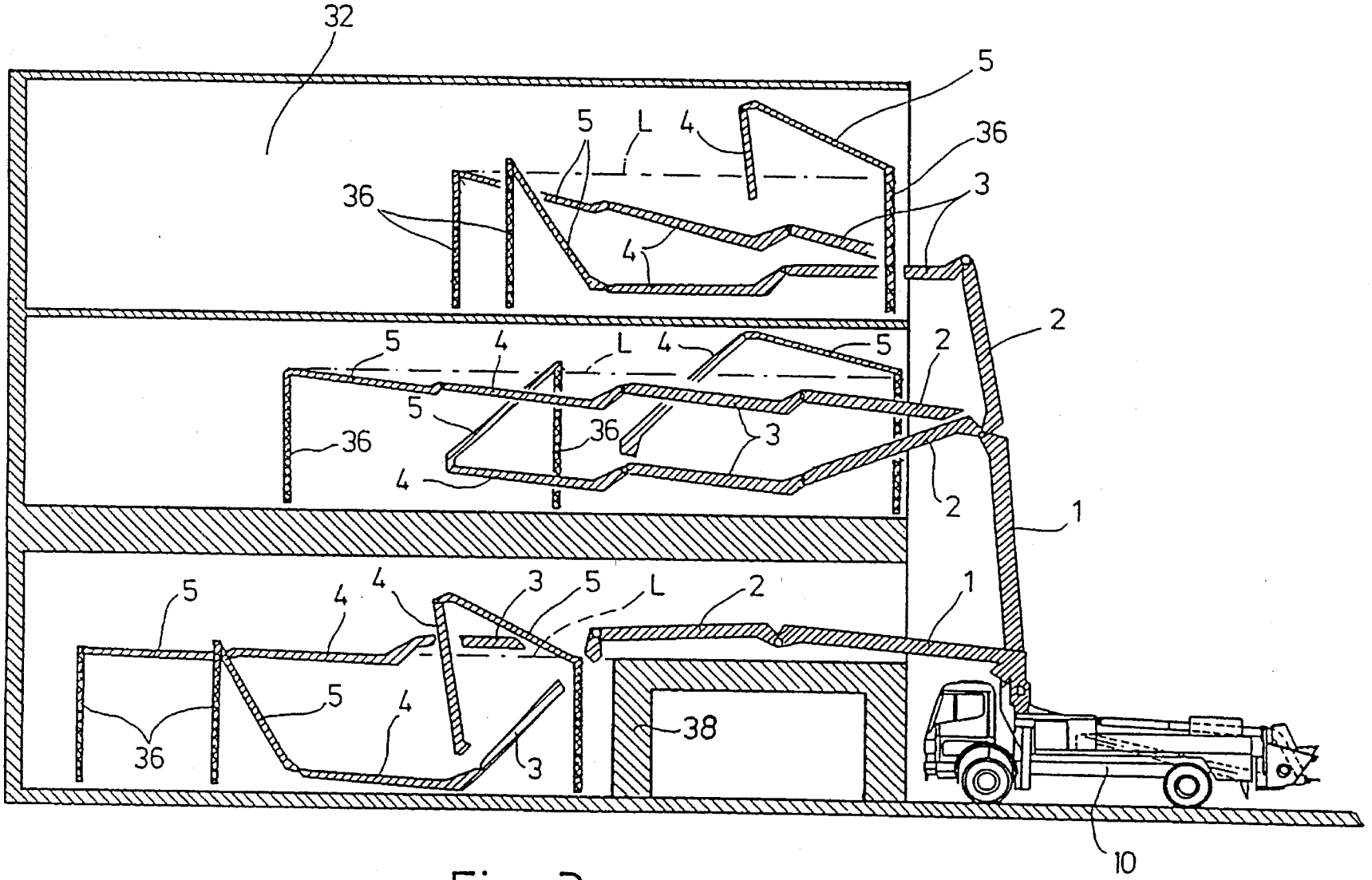
FIG. 3 illustrates the mobile concrete pump according to FIG. 1 during concreting in buildings, which are several stories high, and during concreting after overcoming an obstacle.

The special characteristics of the above-described five-arm concrete-distribution rig 20 can be seen most of all in the movement analysis illustrated in FIG. 3. Thus it is possible during the ground-level concreting to use the arm 2 together with the arm 1 to overcome obstacles 38, for example, partition walls, hall structures and the like, whereby the arms 3 to 5 independent of the arm 2 can be manipulated between their extended position and a position proximate the obstacle 38 for guiding of the end hose 36. A similar situation exists when concreting higher floors, where the arm 2 together with the arm 1 is used to bridge distances in a vertical direction. These concreting tasks, which are often encountered in practice, cannot be solved with the conventional concrete-distribution rigs.

Figure 4A:
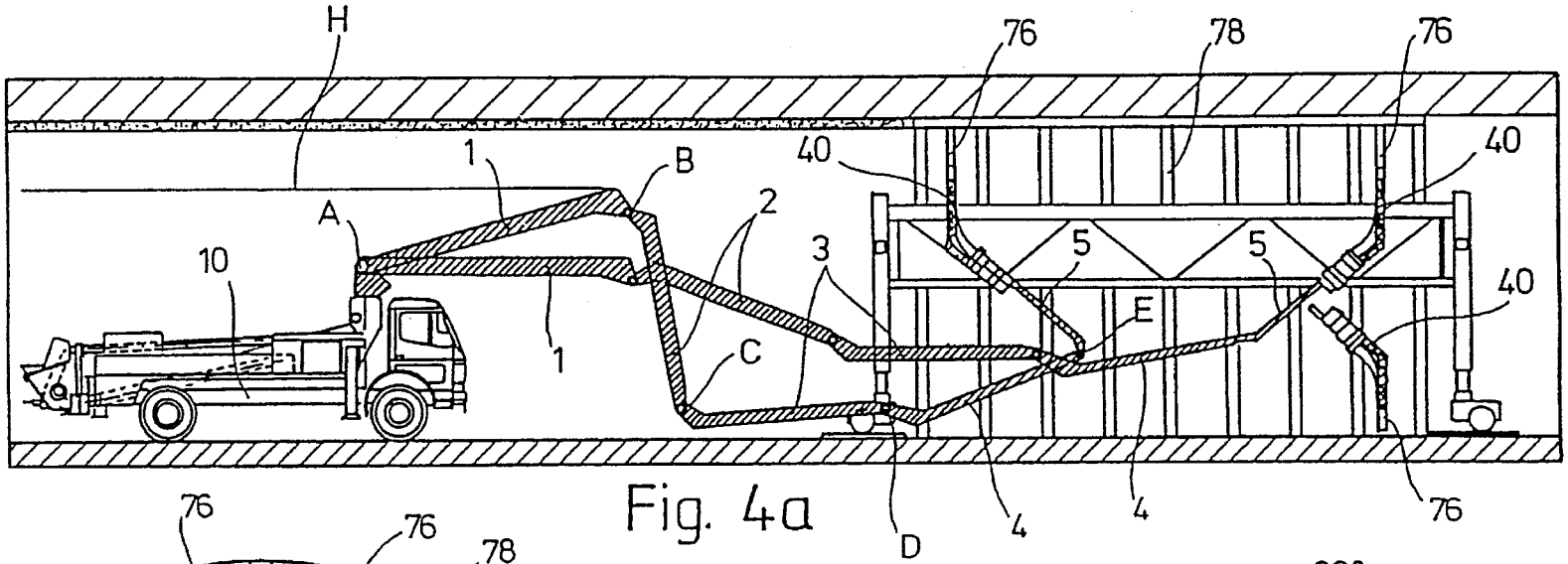
FIGS. 4*a* to 4*c* illustrate a side view and front view of the concrete pump according to FIG. 1 with an end-hose manipulator mounted on the concrete-distribution rig for filling tunnel forms, and illustrate an enlarged side view of the end-hose manipulator.
Figure 4B:
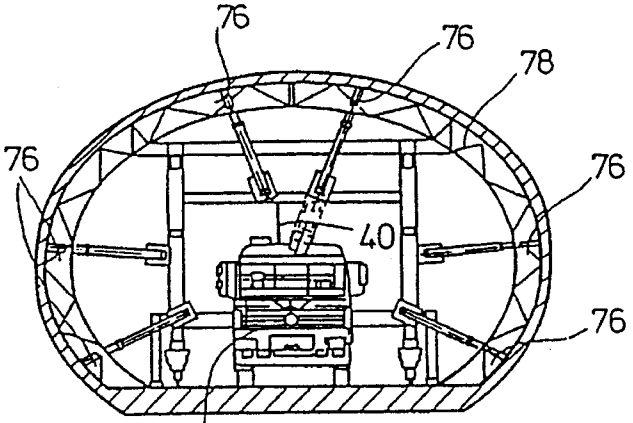
Figure 4C:
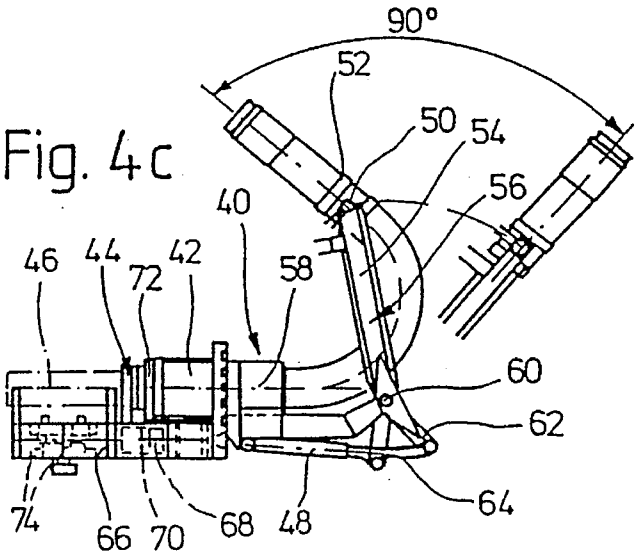

As is shown in FIGS. 4*a* to 4*c*, the described mobile concrete pump also can be utilized for concreting tunnels, when the end rig arm 5 also is equipped with a hydraulically operable and/or motor operable end-hose manipulator 40. The end-hose manipulator 40 can be connected to the last pipe section 46 of the end arm 5 of the concrete-distribution rig 20 by a rigid pipe piece 42 and a pipe rotating joint 44. The pipe piece 42 has a support structure 58 at its front end to which a hydraulic cylinder 48 is pivotally supported and aligned essentially parallel with respect to an axis of the pipe piece 42.

The flexible end hose 36 is connected at the front end of the pipe piece 42 and includes a sleeve 50 designed as a clamping bar in its end-side third section. The sleeve 50 has lateral pivot bearings 52, to which the fork-shaped weight arm 54 of a two-arm rocking lever 56 is hinged.

The rocking lever 56 is pivotally supported about an axis 60, which is parallel to a common axis between the pivot bearings 52, at the end of a support construction 58 extending essentially axially beyond the pipe piece 42. The rocking lever 56 is connected to the piston rod 64 of the hydraulic cylinder 48 at its power arm 62, which is angled with respect to the weight arm 54. By operating the hydraulic cylinder 48, the rocking lever 56 can be pivoted at an angle of approximately 60°. This pivoting movement is transferred into a bending of the end hose 36 whereby the connecting piece of the end hose 36 projecting over the sleeve 50 moves through an effective angle of traverse of 90°.

A housing 66 for receiving a hydraulic motor 68 furthermore is arranged on the pipe section 46 wherein the drive shaft 70 of the hydraulic motor 68 can be coupled with the pipe piece 42 through a chain drive 72. The pipe piece 42 can thus be rotated relative to the pipe section 46 by the motor 68 into any desired rotary position. The rotating and tilting movement of the end hose 46 is done through hydraulic control of the hydraulic motor 68 and of the hydraulic cylinder 48 through the control valves 74 arranged in the housing 66 where the control is provided with the help of a remote control, which is not illustrated. Thus it is possible to connect the end hose 36 to the successive concreting nozzles or windows 76 of a tunnel form 78 by suitably operating the distribution rig 20 and the end-hose manipulator 40.

In conclusion the following must be stated: The invention relates to a five-arm concrete-distribution rig 20 mounted on a vehicle, the rig arms 1, 2 and 3 of which can be folded together in opposite rotational directions at their hinged joints B and C, which have a pivoting range of motion of approximately 180°, to form a Z shape. In order to make it possible to supply concrete through the parallel end hose over obstacles and into upper floors, the rig arms 3, 4 and 5 of the invention can be roll folded together at their joints D and E, which have a pivoting range of motion of approximately 270°, wherein each rig arm rotates in the same rotational direction relative to the rig arms 2 and 3 within the area of their hinged joint C.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a five-arm concrete-distribution rig arranged on a vehicle, comprising a rig arm hinged to a horizontal axis pivot joint provided on a pivot-bearing block arranged on said vehicle, said pivot-bearing block being rotatable about a vertical axis, a second, a third, a fourth and a fifth rig arm all lying, in a travelling position, under said rig arm and foldable in pairs about a plurality of hinged joints to a respective preceding said rig arm in essentially parallel alignment to one another, and a plurality of pipe sections of a feed pipe, said feed pipe being loadable with concrete and leads to an end hose hinged to a free end of said fifth rig arm at a first pipe rotating joint, said pipe sections extending coextensively with said rig arms and are connected with one another at a plurality of second pipe rotating joints which are axially parallel with respect to said hinged joints, said first and second rig arms and said second and third rig arms being foldable in a Z-pattern relative to one another in opposite rotational directions at their respective said hinged joints and having a swivelling range of approximately 180°, the improvement wherein said third and fourth rig arms and said fourth and fifth rig arms are roll foldable against one another at their respective said hinged joints each in a same rotational direction with said rig arms roll folded between said second and third rig arms in an area of its respective hinged joint.

2. The concrete-distribution rig according to claim 1, wherein said hinged joints have an angle of traverse of approximately 270°.

3. The concrete-distribution rig according to claim 1, wherein all said pipe sections and respective ones of said second pipe rotating joints rotate about a single axis each arranged on a same side of a respective said rig arm.

4. The concrete-distribution rig according to claim 1, further comprising an end-hose manipulator means arranged on said free end of said fifth rig arm for effecting a driven remote controlled movement of said end hose.

* * * * *